United States Patent [19]

Rassieur

[11] 4,405,020

[45] Sep. 20, 1983

[54] AUTOMATIC DRIVE HAMMER SYSTEM

[75] Inventor: Charles L. Rassieur, Creve Coeur, Mo.

[73] Assignee: Central Mine Equipment Company, St. Louis, Mo.

[21] Appl. No.: 283,490

[22] Filed: Jul. 15, 1981

[51] Int. Cl.[3] ..... B25D 9/00

[52] U.S. Cl. ..... 173/89; 173/29; 173/124; 73/84

[58] Field of Search ..... 173/28, 39, 42, 44, 173/84, 89, 86, 124, 13, 15, 29; 73/12, 82, 84

[56] References Cited

U.S. PATENT DOCUMENTS

| | | | |
|---|---|---|---|
| 2,599,995 | 6/1952 | Hobson et al. | 173/124 |
| 3,205,952 | 9/1965 | Sicotte | 173/124 |
| 3,216,511 | 11/1965 | Ladd et al. | 173/89 |
| 3,369,616 | 2/1968 | McGonigal et al. | 173/124 |
| 3,543,868 | 12/1970 | Drake | 173/124 X |
| 3,732,935 | 5/1973 | Gibson | 173/28 |

*Primary Examiner*—James G. Smith
*Assistant Examiner*—Robert P. Olszewski
*Attorney, Agent, or Firm*—Polster, Polster and Lucchesi

[57] ABSTRACT

An automatic drive hammer system, particularly adapted to use in the Standard Penetration Test, is mounted on a drill rig in such a way that it can be swung and translated to an on-hole working position. A hammer reciprocating mechanism is so mounted that its weight is not borne entirely by the drill rod, the hammer is dropped free through an accurately predetermined height onto an anvil isolated from the reciprocating mechanism so that all of the energy from the falling hammer is transmitted to the drill rod, and the hammer will not be lifted and released if the anvil is not in place.

12 Claims, 7 Drawing Figures

AUTOMATIC DRIVE HAMMER SYSTEM

BACKGROUND OF THE INVENTION

For subsurface geotechnical exploration, it is customary to drive a 2 in. O.D. split barrel sampler into the soil to obtain a sample and record the number of blows required to drive the sampler a specified distance to determine the penetration resistance of the soil. The penetration resistance has been correlated to quantitative measures of soil behavior. An ASTM Standard D-1586-67 for this procedure known as the "Standard Penetration Test" or "SPT" is available. This standard in part states "The assembly shall consist of a 140 lb. (63.5 kg) weight, a driving head, and a guide permitting a free fall of 30 in. (0.76 m)." In the description of the preferred embodiment and in the claims, the "weight" is referred to as the hammer to distinguish it from the mass of one or more of the components.

The most common method of driving the sampler is by lifting a 140 lb. weight with a cathead and rope and releasing the rope allowing the weight to fall and impact on an anvil connected to a drill rod column connected to a split barrel sampler. A cathead is a rotating drum, usually about 8 in. in diameter. A rope is wound around the cathead for one or two turns. One end of the rope is positioned over sheaves at the top of a drill mast and is then attached to a 140 lb. weight. The other end of the rope is held in the hand of the operator. As he pulls the rope, the rope tightens around the revolving cathead. Friction from the rope-drum contact assists in lifting the weight. The weight is raised 30 in. and the operator quickly releases the rope allowing the weight to fall and impact against the anvil. The speed of the operation is usually 40 to 60 blows per minute. A problem with the cathead and rope method is its lack of accuracy. If the operator does not release the rope properly, there may be some retardation of the falling weight resulting in a loss of kinetic energy at impact. Also, a careless operator may not release the rope at the correct height to deliver a 30 in. fall, resulting in over-stroking or under-stroking. Over-stroking results in more energy's being delivered and under-stroking results in less energy's being delivered. To overcome this difficulty, a device known as a trip monkey is sometimes used, particularly outside the United States. With this device the operator raises the weight and when it reaches a predetermined height of 30 in., a latch mechanism contacts a cam surface, allowing the weight to disengage, free fall for 30 in., and impact against an anvil connected to the drill rod column. The trip monkey is usually lifted with a cathead and rope or a hoist. The trip monkey offers an accurate stroke and a free fall of the weight without retardation. However, the trip monkey method is slower than using the cathead and rope method. The trip monkey usually operates at about 20 blows per minute. It is also bulky and more difficult to handle than the standard hammer. Both the cathead and rope drive weight and the trip monkey drive weight require a guide mechanism to insure axial impact with the anvil. The guide mechanism is both axially aligned with and rigidly connected to the drill rod column. The extra weight of the trip monkey mechanism may have an effect on the energy transmitted to the column.

The standard 140 lb. hammer is sometimes used with a wire rope and hoist. The hoist lifts the weight and the operator manually releases the hoist clutch to allow the weight to fall. The wire rope is attached to the weight and as the weight falls, the wire rope is pulled from the hoist drum. The problem with this method is that the inertial forces required to accelerate the hoist drum and frictional losses cause an often variable retardation of the falling hammer so that there is not a true free fall. The accuracy of the fall height with this method is also a problem.

Hydraulically-driven trip monkeys have been made that eliminate some of the objections of other methods. However, they have several disadvantages. They are bulky and hard to handle compared to conventional 140 lb. hammer systems. They are designed to rest on top of the drill rod column that connects to the split barrel sampler and, therefore, apply the weight of the device to the drill rods, affecting the energy transmitted to the rods. These types of devices provide an anvil for the weight to drive against. The lifting and tripping mechanism, however, is connected to the anvil; therefore, some of the impact energy is transmitted to the lifting and tripping parts causing energy losses and damage to the equipment.

The U.S. Army Corps of Engineers has also used a hydraulically driven hammer system, with two lifting lugs on a drive chain, but the use of two lugs limited the cycling speed, and the hammer operating mechanism was supported and guided by the drill rods in the hole, as in the device described above, and no provision was made for preventing the hammer's being operated when the device was not properly positioned.

The use of a driving system is not limited to the SPT. Other tests using different weights and drop heights are in use. Also, driving systems are used to drive drilling tools such as casing into the ground.

It is an object of this invention to provide a self-contained device for lifting a 140 lb. weight and allowing it to free fall 30 in. The device is automated so that the lifting and dropping of the weight is continuous.

Another object of this invention is to provide a device that allows the weight to fall against an anvil that is isolated from the device so that all of the energy from the falling weight is transmitted to the drill rod column.

Another object of this invention is to provide a device that is protected from the forces transmitted at impact, reducing damage to the device.

Another object of this invention is to provide a means for supporting much of the weight of the device so that the full weight is not resting on the rods and the sampler, affecting the accuracy of the test.

Another object of this invention is to provide a means for attaching the device to a drill rig so that it has an over-the-hole working position and an off-hole stored position out of the way of other drilling functions and can be easily moved from the stored position to the working position or from the working position to the stored position.

Another object of this invention is to provide a means to lift or lower the device, preferably hydraulically, so that the device can be vertically positioned.

Another object of this invention is to provide a lifting and tripping mechanism that will provide approximately the same rate of blows per minute as the cathead and rope method, in the range of 40 to 60 blows per minute.

Another object of this invention is to provide a guide system for the hydraulic hammer so that the hammer's vertical movement will be parallel to the feed mechanism of the drill rig and collinear to the axis of the drill rod column in the bore hole.

Another object of this invention is to provide a device that will easily allow the weight size to be changed and the stroke length to be changed.

Another object of this invention is to provide a safety feature so that if the anvil is not in place and the device is activated, the lifting mechanism will not lift the weight and allow it to fall, causing damage to the device.

Another object of this invention is to provide a safer means to drive the sampler, where all moving parts are enclosed.

Other objects of this invention will be apparent to those skilled in the art in light of the following description and accompanying drawings.

SUMMARY OF THE INVENTION

In accordance with this invention, a drill rig is provided with a device for lifting a weight a predetermined height and allowing this weight to free fall and impact on an anvil connected to a drill rod column connected to a sampler and with the anvil isolated from the device. The device is pivotally connected to the drill rig so that it can be swung and translated to an on-hole working position such that the axis of the drive weight and guide is parallel to the axis of the drill rig feed system and collinear to the axis of drilling, or swung to an off-hole stored position out of the way of other drilling functions. When the hammer is being operated, the vertical movement of the device is guided so that the axis of driving remains parallel to the axis of the drill rig feed system and collinear to the axis of drilling. The device has a force-compensating feature to offset part of the vertical forces of the device, other than driving forces, that would otherwise be transmitted to the drill rod column. The device can be raised or lowered hydraulically so that it can be vertically positioned over the drill rods so that the driving function can begin. A safety feature is provided in that if the anvil is not in its proper position, the lifting mechanism will not function to lift the weight and allow it to drop and impact on the device causing damage to the device. Another safety feature is that all moving parts are enclosed. The invention provides an automatic means of lifting and tripping the hammer that is as fast as the standard cathead and rope method.

DESCRIPTION OF THE PREFERRED EMBODIMENT

Figure 1:
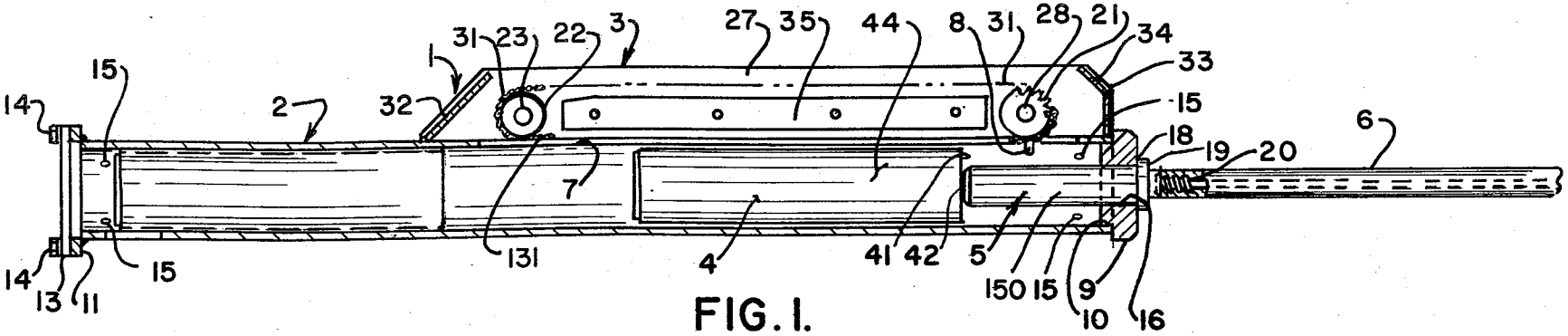
FIG. 1 is a sectional view, lengthwise, of an assembly of drive hammer, housing, anvil and lifting mechanism of one embodiment of drive hammer system of this invention.
Figure 2:
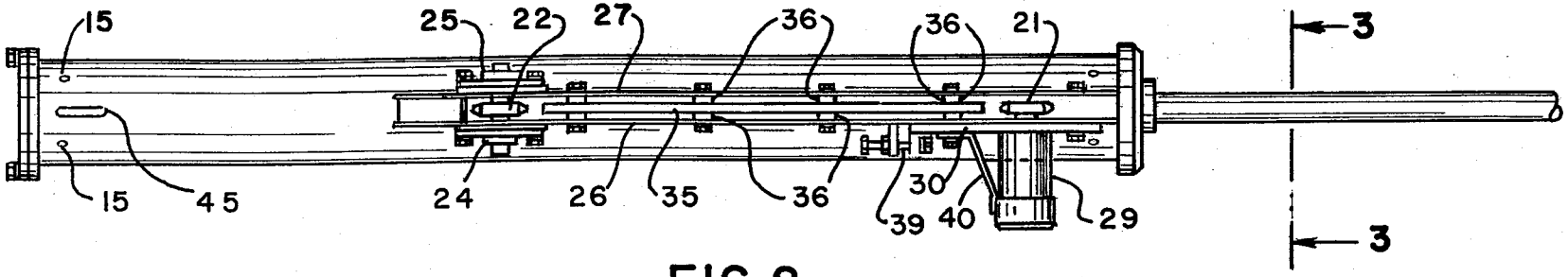
FIG. 2 is a view in rear elevation, with a protective cover removed, of the assembly of FIG. 1.
Figure 3:
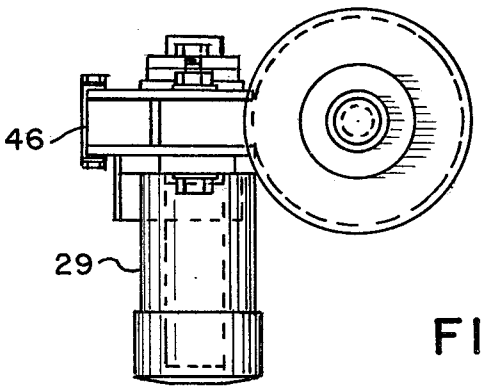
FIG. 3 is a bottom plan view in the direction indicated by the line 3—3, of the assembly of FIG. 2.
Figure 4:
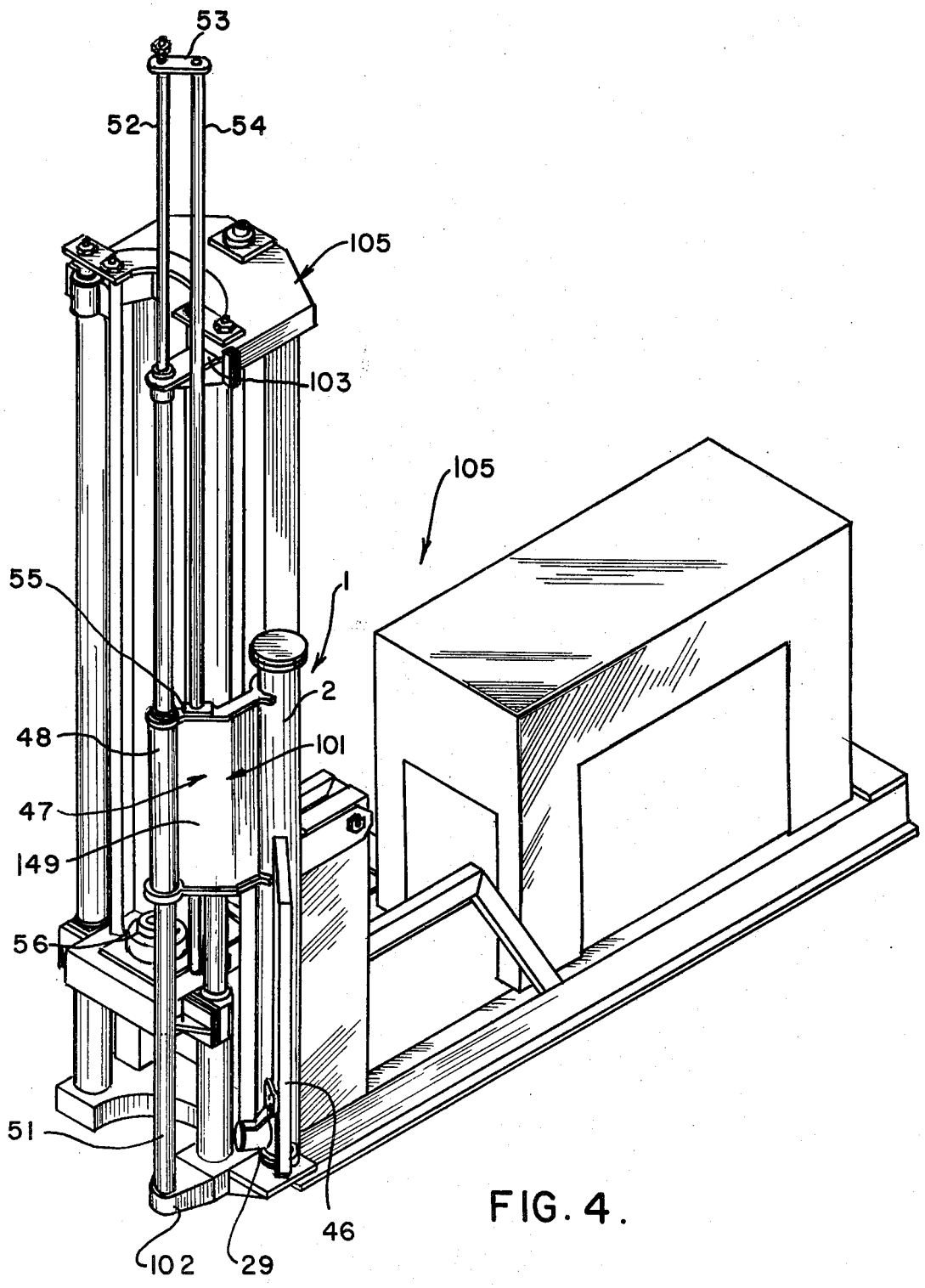
FIG. 4 is a view in perspective of a drill rig including one embodiment of drive hammer system of this invention including the assembly of FIGS. 1–3 mounted thereon, with the system in its stored position.

Referring now to the drawings, reference numeral 1 indicates a drive hammer system of this invention. In the illustrative embodiment shown, the drive system includes a cylindrical housing 2, and a lifting mechanism 3 carried by the housing. The housing 2 and the lifting mechanism 3 are carried by a carriage 101 slidably mounted on the outside of a cylinder 51 extending between a base 102 and a bracket 103. The base 102 is an extension of a base of a drill rig 105 of the type shown and described generally in U.S. Pat. No. 3,561,545. The bracket 103 is spaced vertically above the base 102 and is also secured to the drill rig. The cylinder 51 is oriented parallel to the axis of rotation of a drill spindle 56 of a rotary table.

The housing 2 is closed at its upper end by a top plate 13 bolted to a flange 11 welded to the upper end of the housing. At its lower end, a housing guide or bushing 9, stepped to provide a pilot 10 extending within the housing and provided with a center opening 16, is welded to the housing. The housing wall has a slot 7 machined lengthwise through a part of its height. The housing also has air relief holes 15 near its top and bottom, and an inspection slot 45 near its upper end.

Figure 5:
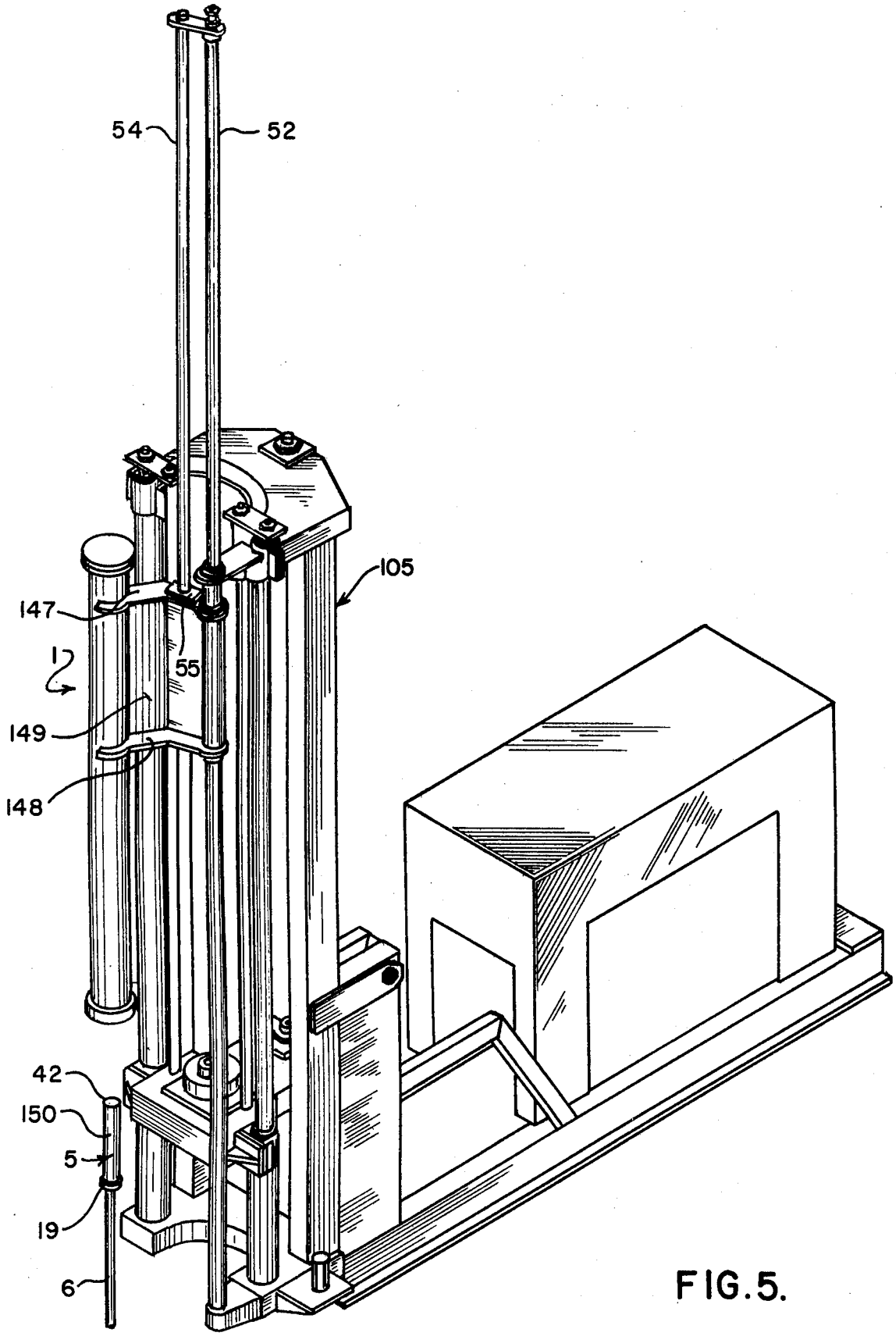
FIG. 5 is a view in perspective of the device shown in FIG. 4, with the drive hammer system in position above a drill rod column to which an anvil has been attached.

Within the housing 2, a hammer or weight 4 is mounted for free vertical movement. The hammer 4 has a cylindrical outer surface 44 and a radial flat striking surface 41. An anvil 5, adapted to be connected to the upper end of drill rods 6 by means of a threaded stud 20 projecting coaxially from the lower end of the anvil, is slidably mounted in the housing 2. The anvil 5, which, in this embodiment is cylindrical, has a radially outwardly projecting flange 19 just above the stud 20, a uniformly cylindrical impact end section 150 projecting upwardly within the housing when the hammer system is in operation, and an upper flat radial impact surface 42, as shown in FIGS. 1 and 5. As indicated in FIG. 5, the anvil 5 is freely removable from and insertable within the housing, and as will be described, the housing is in practice usually lowered over and around the anvil. The height of the projection of the impact end of the anvil within the housing is accurately limited by the abutment of the flange 19 of the anvil against a radial lower surface 18 of the housing guide bushing 9.

The lifting mechanism 3 has a lower, drive sprocket 21, mounted on a lower shaft 28, and an upper, idler sprocket 22 mounted on an upper shaft 23 supported by bearings 24 and 25. The bearings 24 and 25 are mounted on parallel, spaced support plates 26 and 27. The lower shaft 28 is connected to a rotary actuator 29, which in the embodiment shown, is a hydraulic motor, provided with the usual fittings, connected, by flexible hydraulic lines, not here shown, to and from a source of fluid under pressure. The motor 29 is mounted on an outboard plate 30 that is bolted to support plate 26 and arranged to be adjusted for taking up slack by means of an adjusting bolt 39. A brace 40 extends between plate 30 and a laterally outboard part of the motor. Spacer braces 32, 33 and 34 are welded to the housing and to the support plates 26 and 27. A drive chain 31, tending around the sprockets 21 and 22, is guided by a chain guide 35 bolted between the plates 26 and 27, positioned vertically between the two sprockets 21 and 22 and centered laterally by washers 36. The chain 31 carries a single lifting lug 8, that projects laterally from the chain through the slot 7 within the housing 2, radially between the impact end 150 of the anvil and an outer cylindrical surface 44 of the hammer 4 and axially below the striking surface 41 of the hammer in normal operation, as shown in FIG. 1, through one vertical reach 131 of the chain 31. A cover 46 encloses the entire lifting mechanism.

In the embodiment shown, the carriage 101 includes a pivot arm 47, which in this embodiment includes upper and lower flanges 147 and 148 and a central web 149, welded at one edge to the outside surface of the housing 2, and a sleeve 48 bushed to be closely but slidably mounted on cylinder 51. The housing 2 is oriented parallel with the cylinder 51. The cylinder 51 is a hydraulic cylinder, with a piston mounted within it, with a piston rod 52 projecting from its upper end. The upper end of the piston rod 52 carries a connector 53 which in turn carries a positioning rod 54. The positioning rod 54 is connected at its upper end to the connector 53, and at its lower end to a connector plate 55 bolted to the upper surface of upper flange 147 of the pivot arm 47. The hydraulic cylinder 51 is provided at its lower, blind, end with the usual fitting or fittings to which one or more flexible hydraulic lines to and from a source of fluid under pressure, not here shown, are connected. In the illustrative hydraulic system shown in FIG. 7, a single hydraulic line 151 is connected at one end to a fitting on the blind end of the cylinder 51, which, in this embodiment, is a single acting hydraulic cylinder. The line 151 is connected at its other end to a directional control valve 152 that is in turn connected to a source of fluid under pressure. The directional control valve 152 is so constructed as to connect the line 151 with the source of fluid in one position of the control valve, and in another, neutral position, to block the line 151, preventing flow in either direction through the end of the line 151. Intermediate its ends, the line 151 is connected to an exhaust line 153 leading to a tank or sump 155 through a manual shutoff valve 154. Also intermediate its ends, the line 151 is connected to a pressure relief valve 160, equipped with a pressure gauge 161. The pressure relief valve has a relief line 162 leading, by way of a relief manual shutoff valve 164 to a sump or tank 165 which can be the same as the tank 155.

The drill rig, including the spindle and rotary table, are mounted on a hydraulically operated sliding base by which the rig and spindle can be translated between an operating on-hole position and a retracted off-hole position.

The carriage 47 is so mounted as to permit the housing, hence the hammer, to be swung to an on-hole position immediately forward of the retracted drill spindle 56 for use, and to a storage position over a storage pin 58 mounted on and projecting upwardly from a shelf 59. In the latter position, the system is completely out of the way of the drive spindle.

In operation, the drill rig, with the drive hammer assembly stowed in its off-hole position, is positioned at a place at which the hammer device can be swung to an on-hole position, immediately above and coaxial with a drill rod string. The anvil 5 is screwed onto the top of the drill rod. The manual shutoff valves 154 and 164 are closed. The directional control valve is moved to the position at which fluid from the fluid source is admitted to the hydraulic cylinder 51, causing the piston in that cylinder to rise, lifting the hammer device off of the storage pin 58, to a height above the height of the top of the anvil 5. The housing is then swung to a position immediately above the anvil. The directional control valve is then moved to its neutral position, blocking the end of the line 151. The manual shutoff valve 154 is then opened to allow fluid in the cylinder to be exhausted sufficiently to permit the housing to move down to permit the impact end of the anvil to pass through the opening 16 in the housing bushing, supporting the hammer as the bottom of the housing continues to move down. The housing moves down until the flange 19 of the anvil engages the surface 18 of the bushing. At this point, the weight of the hammer is resting upon the anvil, at a distance above the upper surface of the bushing determined by the length of the impact end section 150 above the flange 19. The shutoff valve 154 is then closed and the relief manual shutoff valve 164 is then opened. The setting of the pressure relief valve will determine the counterbalancing force supporting the drive hammer assembly. If the pressure relief valve is set above the effective weight of the assembly (housing, hammer, lift mechanism, carriage, rod 54, piston and rod 52, and connector 53) only the weight of the hammer is carried by the anvil and drill string when the device is in the static position described, and the housing will not move down under is own weight. However, if the counterbalancing force is adjusted so that the acceleration force of the hammer as it is lifted from the anvil, as described hereinafter, causes the force on the relief valve to exceed that valve's setting, on the initial stroke, that excess force will be transmitted to the drill column. If the counterbalancing force exceeds the weight of the assembly including the hammer, this transmitted force will in practice be less than the weight of the hammer in the static state from which the stroke starts. If it does not, this is still an insignificant force compared with the prior art devices in which the entire weight of the device has been born by the drill column. After the first stroke, when the anvil moves down away from the housing, the assembly will move down to the position at which it engages the flange on the anvil as the hammer is being elevated, and exert only a negligible force on the drill column. It can be seen that any amount of counterbalancing force can be obtained. The cylinder 51 is preferably made much longer than the expected travel of the housing during a test. Merely by way of example, the housing may move through 18 inches as the drill string is driven, and the cylinder may be made 6 feet long, so that there is an ample amount of fluid in the cylinder below the piston at all times.

The motor 29 is now actuated, driving the sprocket 21 clockwise as viewed in FIG. 1. The height of the impact section of the anvil is such as to support the hammer well above the axis of rotation of the sprocket 21. Accordingly, as the lifting lug 8 moves around the sprocket 21 and through the slot 7, it engages the striking surface 41 of the hammer 4, lifting the hammer from the anvil and accelerating the hammer weight from rest to the speed of the chain in the process. This is what gives rise to the acceleration force of the hammer. When the lug 8 reaches the sprocket 22 and begins to move outwardly, the lug moves from under the surface 41, permitting the hammer to fall free until it strikes the impact surface 42 of the anvil. Because the anvil is unconnected to the housing, all of the energy of the hammer is transmitted to the anvil, without affecting the housing at all. The exact position of the hammer at the moment of its release can be observed through the inspection slot 45. Because of the speed of the chain 31 and the momentum of the hammer, the hammer is thrown a short distance above the point at which the lug carries it. The amount of the throw is predetermined and the dimensions of the hammer, anvil and housing are such as to take that throw into account in producing a fall of exactly thirty inches in the SPT, or whatever the fall desired in some different application. However, to change the length of the stroke, the impact section of the anvil can be shortened or lengthened. The speed of the chain is determined by the desired number of stokes per minute. It has been found that a number of strokes corresponding to those obtained with a cathead can only be achieved by the use of a single lifting lug. If two lugs are employed, the chain must be run more slowly or else the second lug will get into the housing before the weight has completed its fall.

If for any reason the anvil is not in place, so that the hammer is either resting on the bottom of the housing, or is not supported by the anvil above the drive sprocket 21, the lug 8 will engage the outer surface 44 of the hammer. The hydraulic system supplying fluid to the motor 29 is provided with a relief valve limiting the force that will be exerted by the motor to an amount sufficient to raise the hammer, but insufficient to break the lug or chain if the lug engages the side wall of the hammer. Accordingly, the motor 29 will simply stall, and the hammer will not be moved up nor will the chain be broken.

As has been described heretofore, the relief valve setting is preferably adjusted so that the housing 2 does not move downward after the anvil has moved down in response to a blow from the hammer, but will do so when the lifting lug again engages the surface 41 of the hammer and begins to move the hammer upwardly. Less counterbalancing force will permit a part of the weight of the drive hammer assembly to rest upon the anvil flange, hence the drill string; too much more counterbalancing force will keep the housing from moving down at all, which would lead finally to the hammer's reaching the position at which the lug 8 engages the outer cylindrical surface 44 of the hammer, causing the motor 29 to stall. If it were not for this safety feature, the housing would impinge upon the upper surface of the pilot 10 of the housing guide 9, jeopardizing the integrity of the housing.

Figures 6, 7:
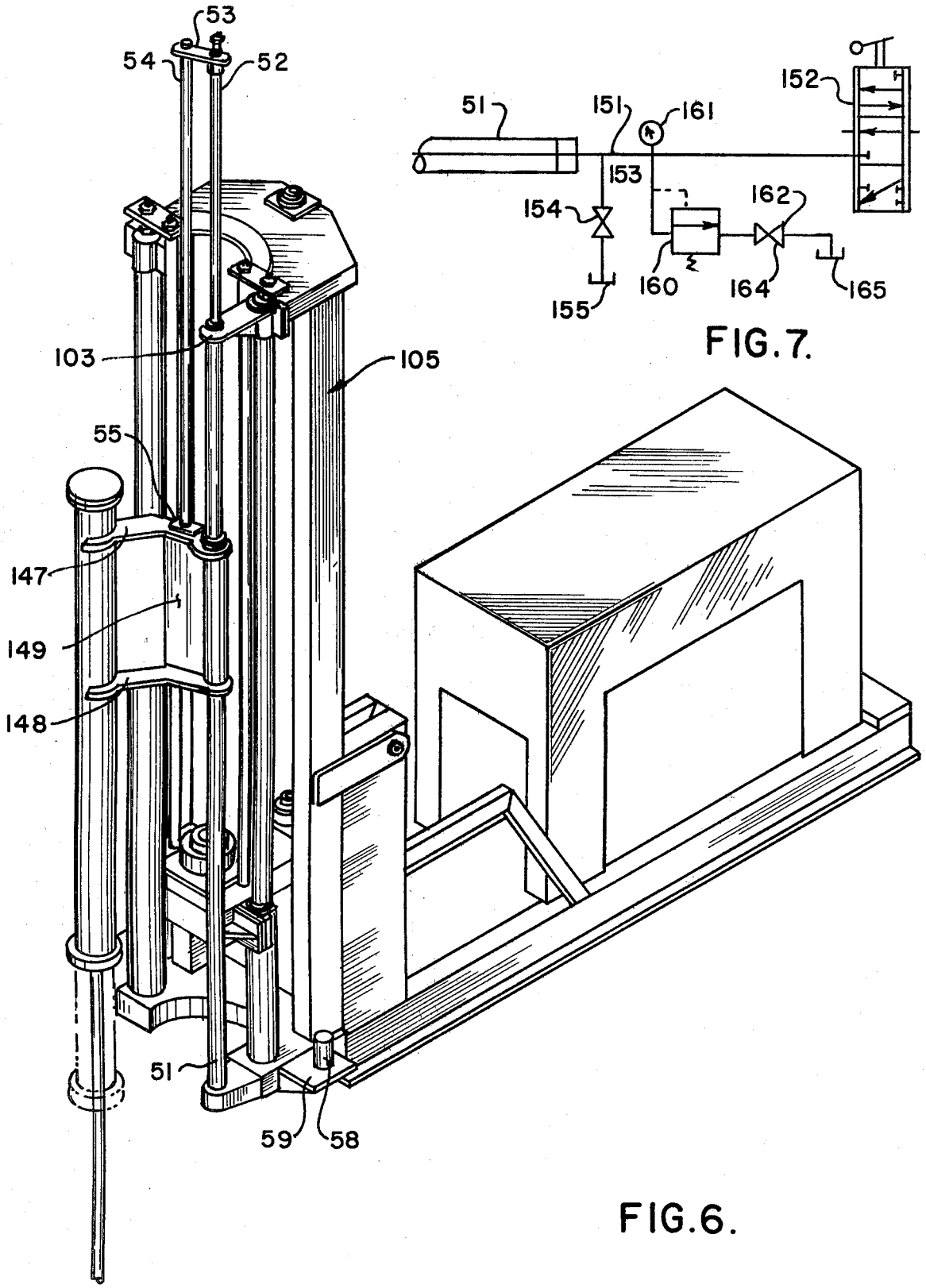
FIG. 6 is a view in perspective of the device showing the drive hammer system in its operating position.
FIG. 7 is a diagrammatic view of one embodiment of hydraulic system by which the drive hammer assembly is translated vertically and counterbalanced.

After the sampler has been driven 18 inches, the hammer housing will be positioned 18 inches lower than it was at the beginning of the test, as indicated in broken lines in FIG. 6. If it is an SPT, the test is then completed. The relief manual shutoff valve 164 is closed and the directional control valve 152 is moved to the position at which hydraulic fluid from the source is admitted to the line 151, hence to the bottom of the cylinder 51, to raise the carriage and housing off the anvil and above the level of the storage pin 58. The carriage and housing are swung to a position at which the opening 16 is aligned with the storage pin 58, the directional valve is returned to its neutral position and the manual shutoff valve 154 is opened to permit the housing to move down onto the pin. The anvil 5 is unscrewed from the drill rod, and the drill string is hoisted from the hole and the sampler removed. In the illustrative device shown and described, the drill rig carriage can be moved hydraulically to position the spindle directly over the hole, for drilling.

The device has been described in terms of the SPT, with a 140 lb. weight dropped through a height of 30 inches. It can be seen that by increasing or decreasing the length of the hammer, the weight can be varied without modifying any other part of the device, provided the housing is made tall enough to accommodate any anticipated weight. The drop height may be reduced by the simple expedient of increasing the length of the impact section of the anvil 5. Again, if it is anticipated that a longer drop will be desired, the slot 7 and reach 131 can be made suitably long and the length of the impact section of the anvil can be adjusted accordingly.

The construction of the device of this invention is such as to ensure that the anvil and the fall of the hammer remain collinear with the axis of the rod column throughout the course of the driving of the rod column.

Numerous variations in the construction of the drive hammer system of this invention within the scope of the appended claims will occur to those skilled in the art in the light of the foregoing disclosure. Merely by way of example, the housing can be made of a different cross-sectional shape, as for example square, and the hammer may be given a corresponding shape or a different one, as for example, a cylindrical shape in a polygonal housing. Although hydraulic motors and cylinders are preferred for their versatility, pneumatic or electric systems can be used, or, for the counterbalancing, counterweights. The carriage can take other forms, even to that of a lifting eye secured to the housing, although the construction described has many advantages, and the lifting mechanism can be mounted on a framework of the carriage, rather than directly on the housing, although the arrangement shown and described has advantages. These are merely illustrative.

I claim:

1. In an automatic drive hammer system wherein a hammer is mounted in a tubular housing and mechanism, mounted with said housing, is provided for lifting said hammer a predetermined distance and allowing it to fall free in said housing, the improvement comprising carriage means for carrying said housing and lifting mechanism and means for mounting said carriage on a drill rod feed mechanism support structure of a drill rig drive having a drill rod fed along a vertical axis, said support structure including a vertical member offset laterally from and parallel to the axis of said drill rod feed, and said means for mounting said carriage on said drill rig drive including means for mounting said carriage on said vertical member rotatably and slidably for swinging movement between an on-hole, operating, position and an off-hole, stored, position.

2. The improvement of claim 1 including means for translating said carriage vertically on and with respect to said vertical member.

3. The improvement of claim 2 including counterbalancing means for maintaining a counterbalancing force against downward movement of said carriage at least equal to the combined weight of the hammer, housing, mechanism and carriage, but less than the force exerted by said combined weight plus the acceleration force applied when said hammer is lifted by said mechanism.

4. The improvement of claim 2 wherein said means for translating includes means for maintaining against said carriage a counterbalancing force of an amount less than the combined weights of the hammer, housing and lifting mechanism.

5. The improvement of claim 1 including an anvil mounted for free movement in said housing and positioned to be struck by said hammer.

6. The improvement of claim 5 wherein said anvil, slidably mounted in the said housing for the free movement axially of said housing, has a part extending axially within said housing and a laterally extending stop member adapted to engage an external face of said housing whereby when said stop member engages the said housing face, the height of said axially extending anvil part determines the drop height of a hammer of a given length.

7. The improvement of claim 1 including means for totally enclosing the hammer and lifting mechanism when said hammer lifting mechanism is in operation.

8. The improvement of claim 1 wherein said mechanism for lifting said hammer comprises a drive chain carrying a single lifting lug, said drive chain being mounted on spaced sprockets with one reach of said chain extending axially of said housing immediately adjacent said housing and said lifting lug projecting, through the length of that reach, through a slot in said housing to engage a lateral surface of said hammer.

9. The improvement of claim 1 wherein the housing includes means for permitting visual inspection of the hammer at its uppermost position.

10. In an automatic drive hammer system wherein a hammer is mounted in a tubular housing and mechanism, mounted with said housing, is provided for lifting said hammer a predetermined distance and allowing it to fall free in said housing, the improvement comprising means for mounting said housing and mechanism on a drill rig for movement between an on-hole, operating, position and an off-hole, stored, position, said lifting mechanism comprising a drive chain carrying a lifting lug, said drive chain being mounted on spaced sprockets with one reach of said chain extending axially of said housing immediately adjacent said housing and said lifting lug projecting, through the length of that reach, through a slot in said housing to engage a lateral surface of said hammer, thereby to lift said hammer, when said hammer is supported at a predetermined level within said housing by an anvil, and to engage a side wall of said hammer when the hammer is below said predetermined level, and means for driving said chain having a stall condition substantially below the force at which said lug and chain are damaged when said lug engages said side wall.

11. An automatic drive hammer system comprising a housing with a hammer slidably mounted in said housing for free movement within said housing, an anvil mounted for free movement in said housing, said anvil having a part extending below and outside said housing and an impact end part extending upwardly within said housing, said housing having a vertical slot in it, a lifting mechanism comprising a drive chain extending around sprockets mounted along and aligned with said slot, a lifting lug carried by said chain and extending, along one reach of said chain, through said slot to a position within said housing laterally between said anvil and said hammer when the anvil is properly positioned to support said hammer whereby said lifting lug engages a lateral surface of said hammer and lifts said hammer when it is properly positioned and engages a side wall of said hammer if the hammer is not properly supported by said anvil, and means for limiting the driving force applied to said chain whereby the chain stops when the said lug engages the side wall of said hammer.

12. The device of claim 11 wherein the anvil is provided with a laterally extending stop adapted to engage an outside surface of said housing to limit the height to which the anvil can project within the housing, whereby the length of the impact end of the anvil determines the height of the free fall of the hammer for a given hammer.

* * * * *